US009149839B2

(12) United States Patent
Carr et al.

(10) Patent No.: US 9,149,839 B2
(45) Date of Patent: Oct. 6, 2015

(54) SEALING SYSTEM FOR PRE-TENSIONED COMPOSITE SCREENS

(75) Inventors: Brian S. Carr, Burlington, KY (US); Graham Robertson, Edinburgh (GB); Eric Cady, Florence, KY (US)

(73) Assignees: M-I L.L.C., Houston, TX (US); United Wire Limited, Edinburgh (GB)

( * ) Notice: Subject to any disclaimer, the term of this patent is extended or adjusted under 35 U.S.C. 154(b) by 2204 days.

(21) Appl. No.: 11/862,532

(22) Filed: Sep. 27, 2007

(65) Prior Publication Data

US 2008/0078702 A1 Apr. 3, 2008

Related U.S. Application Data

(60) Provisional application No. 60/827,550, filed on Sep. 29, 2006.

(51) Int. Cl.
*B07B 1/49* (2006.01)
*B07B 1/46* (2006.01)

(52) U.S. Cl.
CPC ..... *B07B 1/46* (2013.01); *B07B 1/4609* (2013.01); *Y10T 29/53* (2015.01)

(58) Field of Classification Search
CPC ..... B07B 1/46; B07B 1/4609; B07B 1/4645; B07B 1/469; B07B 1/48
USPC ..... 209/363, 395, 399, 405, 409, 412
See application file for complete search history.

(56) References Cited

U.S. PATENT DOCUMENTS 6,119,868 A 9/2000 Hiltl
6,269,954 B1 8/2001 Baltzer
6,543,621 B2 4/2003 Baltzer et al.
6,672,460 B2 * 1/2004 Baltzer et al. ..... 209/403
7,150,358 B2 12/2006 Carr et al.
7,273,151 B2 9/2007 Sawall et al.
2002/0056667 A1 5/2002 Baltzer et al.
2004/0245153 A1 12/2004 Seyffert et al.
2005/0103689 A1 * 5/2005 Schulte et al. ..... 209/405

(Continued)

FOREIGN PATENT DOCUMENTS

JP 2005013954 1/2005

OTHER PUBLICATIONS

PCT International Search Report issued in PCT Application No. PCT/US2007/079933 dated Mar. 14, 2008 (3 pages).

(Continued)

*Primary Examiner* — Stefanos Karmis
*Assistant Examiner* — Kalyanavenkateshware Kumar
(74) *Attorney, Agent, or Firm* — Osha Liang LLP

(57) ABSTRACT

A shaker screen including a sealing element and a composite frame, wherein the sealing element is attached to a basal perimeter of the composite is disclosed. Furthermore, a method of forming a shaker screen including forming a sealing element, forming a composite frame, and attaching the sealing element to the composite frame, wherein the sealing element is disposed along at least one surface of a basal perimeter of the composite frame is disclosed. Also, a shaker screen attachment including a sealing element, a composite frame, and a wedge is disclosed. The shaker screen attachment further includes wherein the sealing element is attached to a basal perimeter of the composite frame, and wherein the wedge is disposed between the composite frame and a shaker basket such that the sealing element compresses against the shaker basket.

24 Claims, 4 Drawing Sheets

(56) References Cited

U.S. PATENT DOCUMENTS

| | | | | |
|---|---|---|---|---|
| 2005/0224398 | A1 | 10/2005 | Largent et al. | |
| 2005/0274655 | A1 | 12/2005 | Barrett et al. | |
| 2006/0163122 | A1 * | 7/2006 | Bakula | 209/405 |

OTHER PUBLICATIONS

PCT Written Opinion issued in PCT Application No. PCT/US2007/079933 dated Mar. 14, 2008 (5 pages).
English Patent Abstract of JP 2005-013954 from esp@cenet, published Jan. 20, 2005 (1 page).
Office Action issued in related Canadian patent application No. 2,664,439; Dated Jul. 21, 2010 (2 pages).
Official Action issued in corresponding Canadian Patent Application No. 2,664,439; Dated May 12, 2011 (2 pages).
Supplementary European Search Report issued in corresponding European Patent Application No. EP 07853692.7; Dated Mar. 25, 2011 (5 pages).
Office Action issued in corresponding Chinese Application No. 200780036239.2; Dated Sep. 22, 2011 (7 pages).
Official Action issued in corresponding Mexican Application No. MX/a/2009/003268 with English Language communication reporting the same; Dated Jan. 17, 2012 (7 pages).
Examination Report with English language communication issued in corresponding Argentine Application No. P 07 01 04324; Dated Sep. 2, 2011(7 pages).
First Examination Report in corresponding Indian Application No. 2054/DELNP/2009 dated Oct. 31, 2014 (2 pages).
Office Action issued in corresponding Indonesian Application No. W-00200900805 with English language communication reporting the same; Dated Oct. 11, 2012 (4 pages).
Office Action issued in corresponding Indonesian Application No. W-00200900805 with English language communication reporting the same; Dated Apr. 25, 2013 (4 pages).
Official Action issued in corresponding Mexican Application No. MX/a/2009/003268; Dated May 17, 2012 (4 pages).

* cited by examiner

SEALING SYSTEM FOR PRE-TENSIONED COMPOSITE SCREENS

CROSS-REFERENCE TO RELATED APPLICATIONS

This application, pursuant to 35 U.S.C. §119(e), claims priority to U.S. Provisional Application Ser. No. 60/827,550, filed Sep. 29, 2006. That application is incorporated by reference in its entirety.

BACKGROUND

1. Field of the Disclosure

The present disclosure generally relates to shaker screens and methods of forming shaker screen. More specifically, the present disclosure relates to methods of sealing shaker screens to shaker baskets and methods of forming such seals. More specifically still, the present disclosure relates to shaker screens including sealing elements attached to composite frames and methods of forming the same.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling fluid are commonly referred to in the industry as "shale shakers." A shale shaker, also known as a vibratory separator, is a vibrating sieve-like table upon which returning solids laden drilling fluid is deposited and through which clean drilling fluid emerges. Typically, the shale shaker is an angled table with a generally perforated filter screen bottom. Returning drilling fluid is deposited at the feed end of the shale shaker. As the drilling fluid travels down length of the vibrating table, the fluid falls through the perforations to a reservoir below leaving the solid particulate material behind. The vibrating action of the shale shaker table conveys solid particles left behind until they fall off the discharge end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling fluid flow rates and particulate percentages in the drilling fluid. After the fluid passes through the perforated bottom of the shale shaker, it can either return to service in the borehole immediately, be stored for measurement and evaluation, or pass through an additional piece of equipment (e.g., a drying shaker, centrifuge, or a smaller sized shale shaker) to further remove smaller cuttings.

Because shale shakers are typically in continuous use, any repair operations and associated downtimes are to be minimized as much as possible. Often, the filter screens of shale shakers, through which the solids are separated from the drilling mud, wear out over time and need replacement. Therefore, shale shaker filter screens are typically constructed to be quickly and easily removed and replaced. Generally, through the loosening of only a few bolts, the filter screen can be lifted out of the shaker assembly and replaced within a matter of minutes. While there are numerous styles and sizes of filter screens, they generally follow similar design. Typically, filter screens include a perforated plate base upon which a wire mesh, or other perforated filter overlay, is positioned. The perforated plate base generally provides structural support and allows the passage of fluids therethrough, while the wire mesh overlay defines the largest solid particle capable of passing therethrough. While many perforated plate bases are generally flat or slightly curved in shape, it should be understood that perforated plate bases having a plurality of corrugated channels extending thereacross may be used instead. In theory, the corrugated channels provide additional surface area for the fluid-solid separation process to take place, and act to guide solids along their length toward the end of the shale shaker from where they are disposed.

A typical shale shaker filter screen includes a plurality of hold-down apertures at opposite ends of the filter screen. These apertures, preferably located at the ends of the filter screen that will abut walls of the shale shaker, allow hold down retainers of the shale shaker to grip and secure the filter screens in place. However, because of their proximity to the working surface of the filter screen, the hold-down apertures must be covered to prevent solids in the returning drilling fluid from bypassing the filter mesh through the hold-down apertures. To prevent such bypass, an end cap assembly is placed over each end of the filter screen to cover the hold-down apertures. Presently, these caps are constructed by extending a metal cover over the hold down apertures and attaching a wiper seal thereto to contact an adjacent wall of the shale shaker. Furthermore, epoxy plugs are set in each end of the end cap to prevent fluids from communicating with the hold-down apertures through the sides of the end cap.

Typically, screens used with shale shakers are emplaced in a generally horizontal fashion on a generally horizontal bed or support within a basket in the shaker. The screens themselves may be flat or nearly flat, corrugated, depressed, or contain raised surfaces. The basket in which the screens are mounted may be inclined towards a discharge end of the shale shaker. The shale shaker imparts a rapidly reciprocating motion to the basket and hence the screens. Material from which particles are to be separated is poured onto a back end of the vibrating screen. The material generally flows toward the discharge end of the basket. Large particles that are unable to move through the screen remain on top of the screen and move toward the discharge end of the basket where they are collected. The smaller particles and fluid flow through the screen and collect in a bed, receptacle, or pan beneath the screen.

In some shale shakers a fine screen cloth is used with the vibrating screen. The screen may have two or more overlying layers of screen cloth or mesh. Layers of cloth or mesh may be bonded together and placed over a support, supports, or a perforated or apertured plate. The frame of the vibrating screen is resiliently suspended or mounted upon a support and is caused to vibrate by a vibrating mechanism (e.g., an unbalanced weight on a rotating shaft connected to the frame). Each screen may be vibrated by vibratory equipment to create a flow of trapped solids on top surfaces of the screen for removal and disposal of solids. The fineness or coarseness of the mesh of a screen may vary depending upon mud flow rate and the size of the solids to be removed.

Currently, in many shale shakers, the seal between the screen and the shaker basket is formed by a gasket disposed along the inner perimeter of the shaker basket. In addition to the gasket, a steel rigid support member is often affixed along longitudinal and lateral support members disposed on a bottom or inner surface of the shaker basket upon which the steel frame of the shaker screen rests. The weight of the screen and the disposition of a wedge member between the shaker basket and the screen compresses the gasket between the shaker basket and the frame of the screen. In such an assembly, the compression of the gasket is limited by the thickness of the steel rigid support member. Thus, a relatively thin steel rigid support member will result in greater gasket compression and less space between the screen and the shaker basket. Correspondingly, a relatively thick steel rigid support member will result in less gasket compression and more space between the screen and the shaker basket.

In shale shakers using a steel rigid support member to define the compression between the gasket and the shaker basket, an overly compressed gasket may cause the wedge to loosen and the screen to become loose. When a gasket is overly compressed, the vibrations of the shale shaker may cause the screen to move vertically relative to the shale shaker. When such vertical screen movement occurs, drilling fluid and/or cuttings may pass between the screen and the shaker basket, therein bypassing the screen. The bypassing of such drilling fluid and/or cuttings may decrease the efficiency of the shaking process, as well as allowing cutting matter to settle between the gasket and the shaker basket, thereby resulting in the loss of additional drilling fluid.

When drill cuttings and/or fluid is allowed constant contact with the sealing element of a shale shaker, the sealing element may wear out relatively quickly. In such systems wherein the sealing element is disposed and/or attached to the inner diameter of the shaker basket, replacing the sealing element can be a time consuming process that requires shutting down the shaker system, thus decreasing the efficiency of the process.

Accordingly, there exists a need for a screen frame assembly that may be securely positioned within the shale shaker and effectively form a seal to the wall of the shaker to minimize the passage of unfiltered mud through the screen. Also, there exists a need to increase the efficiency of the shaking process such that when sealing elements are replaced, the process does not substantially decrease the efficiency of the process.

SUMMARY

According to one aspect, embodiments disclosed herein relate to a shaker screen including a sealing element and a composite frame, wherein the sealing element is attached to a basal perimeter of the composite frame.

In another aspect, embodiments disclosed herein relate to a method forming a shaker screen including forming a sealing element and forming a composite frame. The method also includes attaching the sealing element to the composite frame so that the sealing element is disposed along at least one surface of a basal perimeter of the composite frame.

In another aspect, embodiments disclosed herein relate to a shaker screen attachment including a sealing element, a composite frame, and a wedge. Furthermore, the sealing element is attached to a basal perimeter of the composite frame, and the wedge is disposed between the composite frame and a shaker basket such that the seating element compresses against the shaker basket.

Other aspects of the present disclosure will be apparent from the following description and the appended claims.

DETAILED DESCRIPTION

Generally, embodiments disclosed herein relate to shaker screens including sealing elements attached to composite frames. Additionally, methods disclosed herein relate to methods of forming composite frames and seals for use in shaker screens and methods of attaching shaker screens to shakers.

Figure 1:
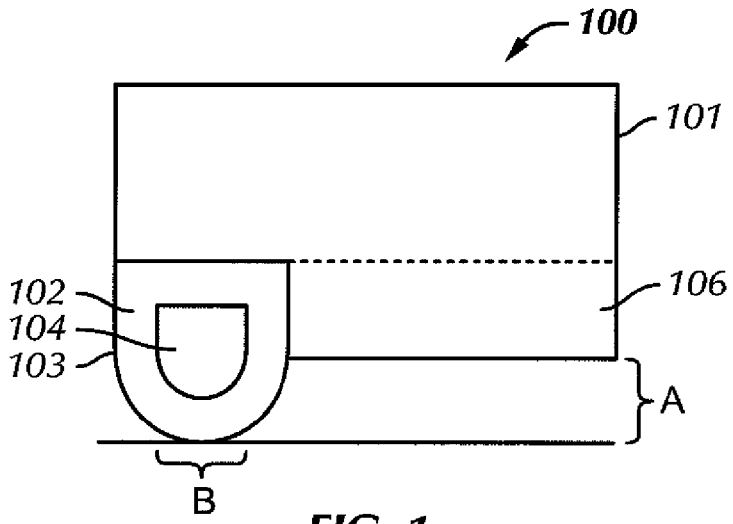
FIG. 1 is a cross-sectional view of a shaker screen in accordance with an embodiment of the present disclosure.

Referring initially to FIG. 1, a cross-sectional view of a shaker screen 100 in accordance with one embodiment of the present disclosure is shown. In this embodiment, shaker screen 100 includes a composite frame 101 and a sealing element 102. Composite frame 101 may be formed from any material known to one of ordinary skill in the art including, but not limited to, high-strength plastic, mixtures of high-strength plastic and glass, high-strength plastic reinforced with steel rods, and any combinations thereof. By using composite frames 101, embodiments of the present disclosure may provide a lighter weight frame with increased durability and strength over conventional steel frames.

Sealing element 102 is illustrated attached to composite frame 101. Sealing element 102 may be formed from any sealing substance known to one of ordinary skill in the art including, but not limited to, rubbers, thermoplastic elastomers ("TPE"), foams, polychloroprene, polypropylene, and/or any combinations thereof. Sealing elements 102 formed from TPE may include, for example, polyurethanes, copolyesters, styrene copolymers, olefins, elastomeric alloys, polyamides, or combinations of the above. Preferably, the sealing element should include properties that allow high durability and elongation, as well as solvent and abrasion resistance. In certain embodiments, sealing element 102 may preferably include the properties of increased flexibility, slip resistance, shock absorption, and vibration resistance. However, one of ordinary skill in the art will appreciate that in alternate embodiments, sealing elements including greater solvency resistance, durability, abrasion resistance, or any other factor corresponding to increased seal life may determine which sealing element is selected.

Sealing element 102 may be formed so as to include an outer surface 103 and an inner area 104. In one embodiment, outer surface 103 may be formed from a lower durometer material than the material of inner area 104. By forming outer surface 103 from a lower durometer material, the lower durometer material may compress more easily against a sealing surface 105. Because outer surface 103 may have a greater resistance to permanent indentation, outer surface 103 may more fully compress against sealing surface 105. Generally, sealing surface 105 may be the frame of a shaker basket (not independently shown) or another component of a given shaker.

Additionally, inner area 104 may be formed from a relatively higher durometer material. In one embodiment, inner area 104 may be formed from a higher durometer material of similar composition, such as a corresponding TPE. In such an embodiment, the lower durometer material may compress against sealing surface 105 until outer surface 103 has compressed fully against inner area 104. Inner area 104, because of its high durometer properties, may provide resistance to compression such that a seal is formed between sealing element 102 and sealing surface 105.

In alternate embodiments, inner area 104 may be filled with a secondary sealing material. One such secondary sealing material may include a foam. The foam may provide resistance to compression, as described above, so as to increase the seal integrity between sealing element 102 and sealing surface 105. Another secondary sealing material may include a gas. Similar to the compressive properties of a foam, a gas may limit the compression of sealing element 102 to a specified range so as to increase the seal integrity between sealing element 102 and sealing surface 105.

Figure 2:
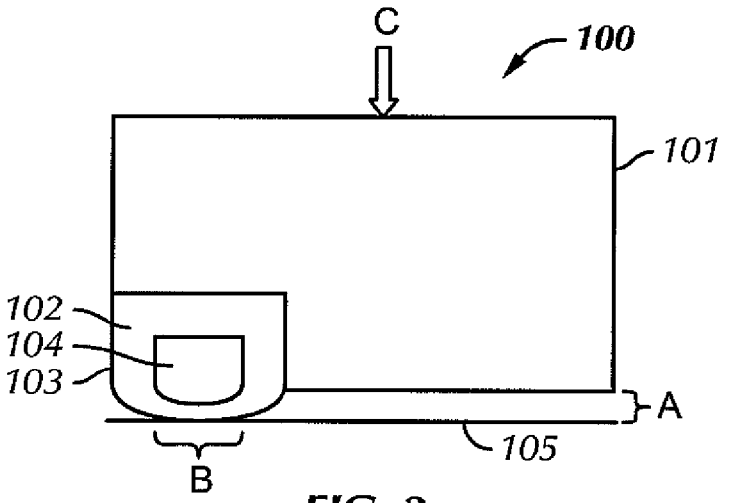
FIG. 2 is a cross-sectional view of a shaker screen during compression in accordance with an embodiment of the present disclosure.

Referring now to FIGS. 1 and 2 together, cross-sectional views of a shaker screen before and during compression are shown, Prior to compression (FIG. 1), sealing element 102 rests on sealing surface 105 with a distance A defined between a lower surface of composite frame 101 and sealing surface 105. Outer surface 103 of sealing element 102 contacts sealing surface 105 along a distance B of outer surface 103 of sealing element 102. As a compressive force is applied in direction C, sealing element 102 compresses against sealing surface 105 such that distance A decreases (FIG. 2). Correspondingly, the distance of outer surface contact B is increased such that more of outer surface 103 of sealing element 102 is in contact with sealing surface 105. The increased sealing surface provides a greater integrity seal that may prevent the escape of drilling fluids between the shaker screen and the shaker. Additionally, because distance A is maintained between composite frame 101 and sealing surface 105, shaker screen 101 may vibrate without contacting the shaker basket. Such distance A may further prevent wear of the shaker basket (not shown), the shaker screen 100, and/or sealing element 102.

Still referring to FIGS. 1 and 2, a rigid molded section 106 defining an extended portion of composite frame 101 is demarcated by a dashed line. Previously, rigid spacers (not shown) made from, for example, steel, were inserted between a frame and a sealing surface to limit compression. However, embodiments disclosed herein allow rigid section 106 to be an integral part of composite frame 101. Because rigid section 106 is integral with composite frame 101, as compressive force C is applied to composite frame 101, there is no need for additional components, such as rigid spacers, to limit the compression of sealing element 102. Thus, in some embodiments, the length of rigid molded section 106 may define a compression limit for sealing element 102. One of ordinary skill in the art will appreciate that in certain embodiments it may be beneficial to provide a rigid section 106 of higher density material than the rest of composite frame 101. However, in alternate embodiments, rigid section 106 may simply be an extended portion of composite frame 101 made from equivalent materials.

Figure 3:
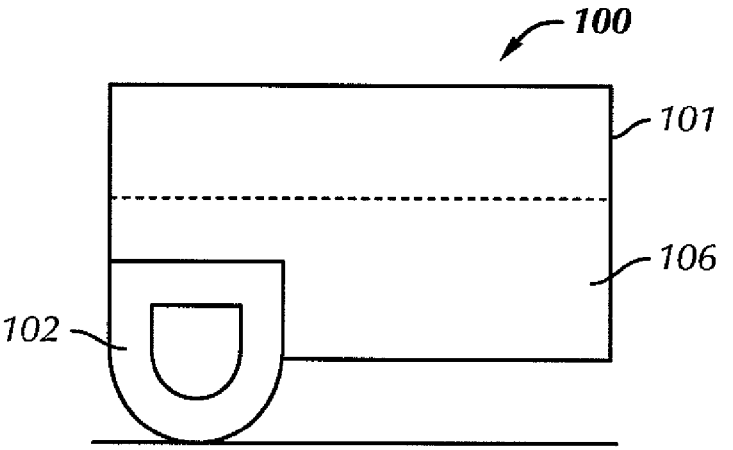
FIG. 3 is a cross-sectional view of a shaker screen in accordance with an embodiment of the present disclosure.

Referring briefly to FIG. 3, a cross-sectional view of a shaker screen 100 in accordance with one embodiment of the present disclosure is shown. In such an alternate embodiment, rigid section 106 may extend further into composite frame 101 to incorporate the region of composite frame directly above sealing element 102. Thus, rigid section 106 would define the entire contact region between sealing element 102 and rigid section 106. Such an embodiment may provide increased bonding potential between sealing element 102 and rigid section 106 as well as providing additional structural support in the optimization of seal compression, as described above.

In addition to rigid portion 106 providing a compression limit, defining rigid portion 106 to be a certain length may also allow sealing element 102 to compress to an optimum level. In such an embodiment, sealing element 102 and rigid portion 106 would be selected together so that as the compression of sealing element 102 reaches an optimal level, rigid portion 106 may contact sealing surface 105 to prevent further compression of sealing element 102. To provide such optimal sealing compression, one or ordinary skill in the art will realize that it may be preferable to allow sealing element 102 to extend longitudinally further than rigid portion 106 while in the resting position (i.e., prior to compression). Furthermore, by using rigid portion 106 as a "hard stop" to provide optimum compression of sealing element 102, over-compression of sealing element 102 is prevented. Because over-compression of a sealing element may contribute to shorter seal life, shorter shaker screen life, or loosening of the shaker screen from the shaker, as described above, using rigid portion 106 as a hard stop may promote extended seal life.

Referring back to FIG. 1, sealing element 102 is illustrated embedded within the profile of composite frame 101. In such an embodiment, sealing element 102 and composite frame 101 may be formed contemporaneously. One such method of forming and attaching sealing element 102 and composite frame 101 may include co-molding, using, for example, injection molding and/or gas injection molding, as is known to those of ordinary skill in the art of molding plastics.

Figure 7:
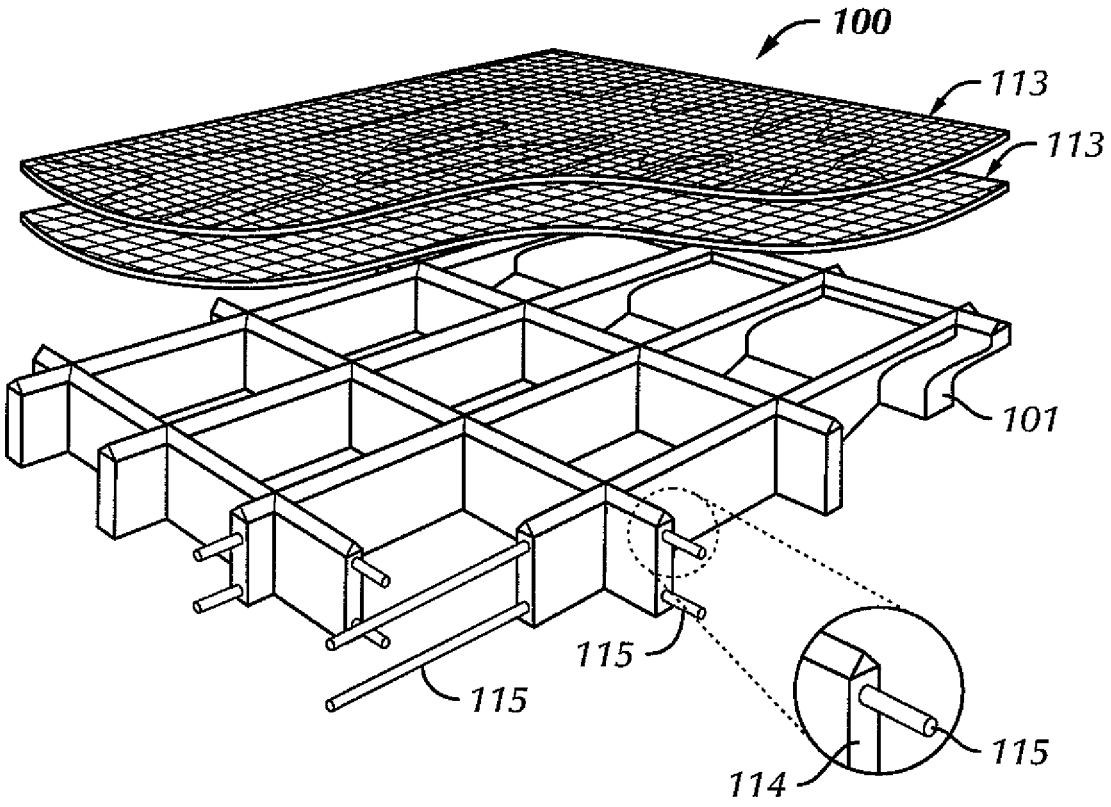
FIG. 7 is a break away view of a shaker screen in accordance with one embodiment of the present disclosure.

Referring briefly to FIG. 7, a breakaway view of a shaker screen in accordance with one embodiment of the present disclosure is shown. Methods of injection molding are well known in the field of plastics manufacture, but may include, for example, forming a composite 114 or polymer material around a wire frame 115 in a mold. In such an injection molding process, the mold may be closed around the wire frame and a liquid polymer injected therein. Upon curing, a force is applied to opposing sides of the mold that allows the formed frame to separate from the mold. In alternate methods of injection molding, gas may be injected into a mold to create spaces in the composites that may later be filled by alternate materials.

Referring back to FIG. 1, one method of co-molding sealing element 102 and composite frame 101 may include integrally molding sealing element 102 within composite frame 101. In this embodiment, sealing element 102 may be positioned within an injection mold for composite frame 101. Once the mold is sealed, a sealing element material (e.g., TPE) may be injected into the mold. The sealing element material is allowed to cure, and then the screen frame including an integrally molded sealing element may be removed. One of ordinary skill in the art will realize that alternative methods of attaching a sealing element to a composite frame exist, for example, using an adhesive resin, and as such, are within the scope of the present disclosure.

Figure 4:
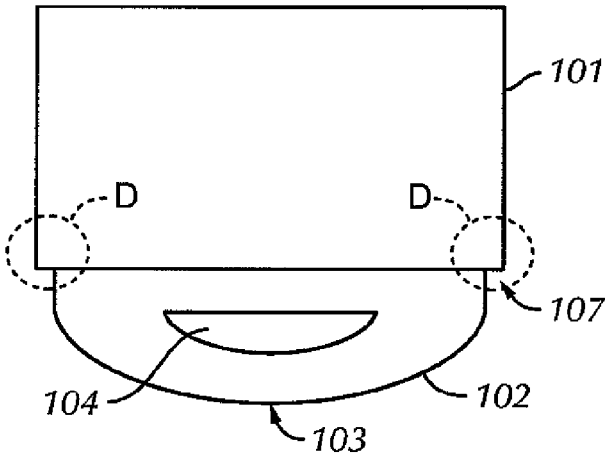
FIG. 4 is a cross-sectional view of a D-shaped sealing element in accordance with one embodiment of a shaker screen of the present disclosure.

Now referring to FIG. 4, a cross-sectional view of a D-shaped sealing element in accordance with one embodiment of a shaker screen of the present disclosure is shown. In this embodiment, sealing element 102 may be attached to composite frame 101 using thermal bonding. Because the frame of the present disclosure is formed of a composite material, as heat is applied, the surface of composite frame 101 and sealing element 102 is softened. At the melting point composite frame 101 and sealing element 102 may contact each other, thereby forming strong bonds, holding the components together. Once cooled, the bonding points will solidify, thereby providing attachment points between sealing element 102 and composite frame 101.

Previously, seals were attached to frames using epoxy and chemical interaction. However, because sealing element 102 may contact chemicals in drilling mud that could degrade epoxy and chemically bonded seals over time, such sealing/bonding methods may decrease seal integrity and seal life. Thermal bonding zones D may provide a seal with greater integrity that is not degraded due to contact with chemicals present in drilling mud. One of ordinary skill in the art will appreciate that alternative methods of bonding sealing element 102 to composite frame 101 may include, but are not limited to, heat staking and ultrasonic welding.

Still referring to FIG. 4, in this embodiment of the present disclosure, a D-shaped sealing element 102 is attached to composite frame 101. Sealing element 102 may be attached to composite frame 101 according to any of the methods described above. Additionally, sealing element 102 is shown attached along a basal perimeter 107 of composite frame 101. Basal perimeter 107 defines a bottom surface of a composite frame, which absent a sealing element, would contact a sealing surface of a shaker.

D-shaped sealing element 102 includes an outer surface 103 and an inner area 104. In such an embodiment, inner area 104 may be filled with a foam or gas, as described above, or may be left unfilled. As illustrated, D-shaped sealing element 102 may extend substantially the entire width of composite frame 101. Thus, the compression resistance of this embodiment relies on the elastomeric properties of sealing element 102, rather than the rigid section of the previous embodiments. However, in such an embodiment, one of ordinary skill in the art will appreciate that a rigid section (not independently illustrated) integral to composite frame 101 may still provide structural support for the shaker screen and/or optimization of seal compression.

Figure 5:
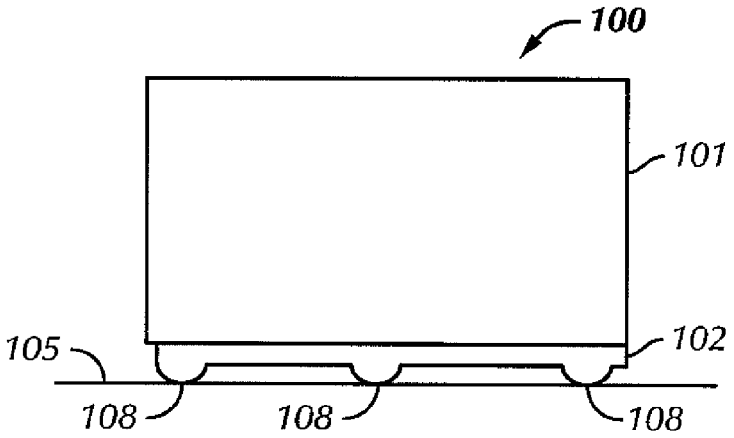
FIG. 5 is a cross-sectional view of a ribbed sealing element in accordance with one embodiment of a shaker screen of the present disclosure.

Referring now to FIG. 5, a cross-sectional view of a ribbed sealing element in accordance with one embodiment of a shaker screen of the present disclosure is shown. In this embodiment, sealing element 102 may be attached to composite frame 101 in accordance with any of the methods discussed above. Also, discussed with reference to FIG. 4, sealing element 102 of the present embodiment provides the only interface with sealing surface 105. In such an embodiment, sealing element 102 may include a plurality of ribs 108 extending from the body of sealing element 102. Ribs 108 may provide structural support for composite frame 101, and may also provide additional sealing integrity for shaker screen 100.

As a compressive force is applied to shaker screen 100, sealing element 102 may be compressed against sealing surface 105. Spaced ribs 108 may provide resistance to the compressive force, thereby providing greater seal integrity between composite frame 101 and sealing surface 105. Additionally, because there may exist a plurality of ribs 108, should one such rib 108 suffer unequal wear and/or damage during its life, the other ribs may continue to provide an ample seal so as to extend the total life of shaker screen 100. One of ordinary skill in the art will also realize that such an embodiment may be preferable in systems that do not have an interface on the shaker basket sufficient to support both a seal and a rigid section. Thus, the seal may also define a compression limit so as to prevent over-compression, thereby extending the usability of such sealing element and corresponding shaker screen. One of ordinary skill in the art will also appreciate that the sealing element may be any shape known in the art, and accordingly, the examples described herein are not meant to limit the shape of the sealing element.

Figure 6:
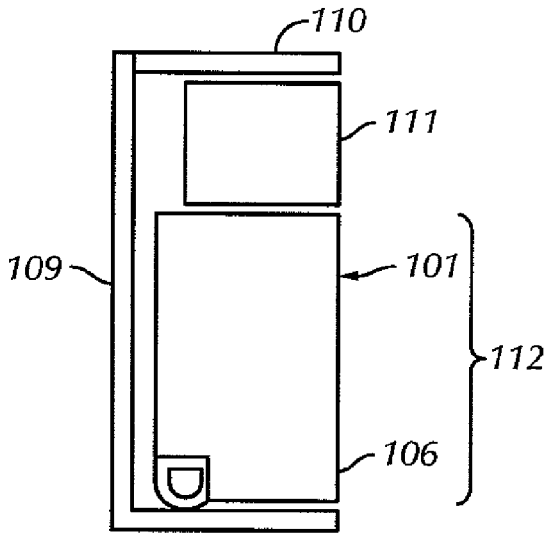
FIG. 6 is a cross-sectional view of a shaker screen attachment in accordance with one embodiment of the present disclosure.

Referring now to FIG. 6, a cross-sectional view of a shaker screen attachment in accordance with one embodiment of the present disclosure is shown. In this embodiment the shaker basket perimeter 109 (i.e., the sealing surface of FIGS. 1-5) is illustrated including a wedge surface 110. A wedge 111 is illustrated between wedge surface 110 and shaker screen 112. Wedge 111 may include any generally polygonal shaped structure capable of applying compressive force between shaker screen 112 and shaker basket perimeter 109. An example of a wedge 111 that may be used in the present shaker screen attachment is disclosed in co-pending U.S. patent application Ser. No. 60/827,582 assigned to the assignee of the present application. Shaker screen 112 may include, for example, a composite screen 101, a rigid section 106, and a sealing element 102. Alternatively, shaker screen 112 may include any of the components previously disclosed in the present application, or any components known to one of ordinary skill in the art.

As wedge 111 is pressed into place between wedge surface 110 and shaker screen 112, a compressive force is applied to sealing element 102, thereby creating a seal between sealing element 102 and shaker basket perimeter 109. The compression of sealing element 102 of the present embodiment may be limited by the extension of rigid portion 106, or by the elastomeric properties of sealing element 102, as discussed above.

Referring back to FIG. 7, in this embodiment, shaker screen 100 includes a composite frame 101, a sealing element (not shown), and a filtering element 113. In certain applications, it may be desirable to decrease the size of particulate matter that may pass through shaker screen 100. In such applications, filtering element 113 may be attached to composite frame 101 so as to limit the size of particulate matter which may pass therethrough. In one embodiment, filter element 113 may include, for example, a mesh, a fine screen cloth, or other materials known to one of ordinary skill in the art. Additionally, filtering element 113 may be formed from plastics, metals, alloys, fiberglass, composites, and polytetrafluoroethylene. In certain embodiments, a plurality of layers of filtering elements 113 may be incorporated into one shaker screen to define a desired separation efficiency or cut. However, in alternate embodiments, filtering element 113 may include a single layer (not shown).

Figure 8:
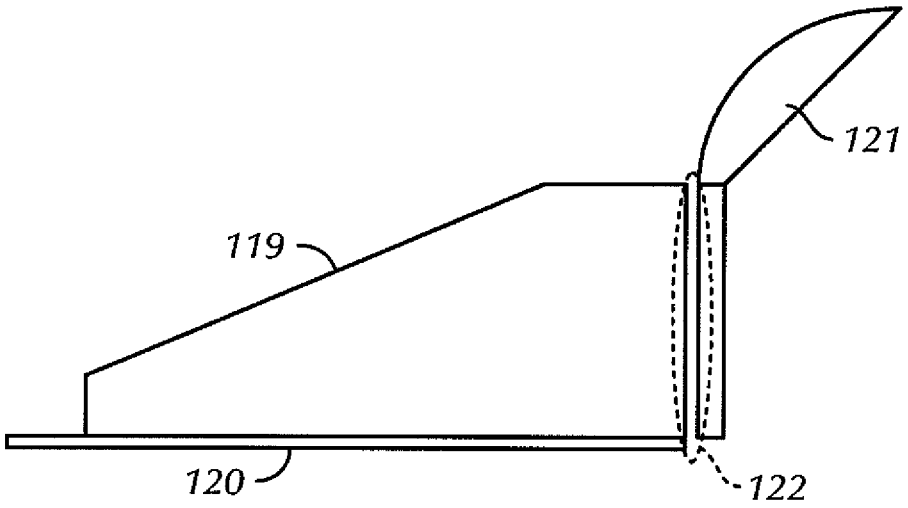
FIG. 8 is a cross-sectional view of a wiper seal in accordance with one embodiment of a shaker screen of the present disclosure.

Referring now to FIG. 8, a cross-sectional view of a wiper seal in accordance with one embodiment of a shaker screen of the present disclosure is shown. In some embodiments, the shaker screen and/or filtering element may include a plurality of hold-down apertures at opposite ends of the screen. These apertures, generally located at the ends of the shaker screen abut walls of the shaker, thereby allowing hold-down retainers of the shale shaker to secure the shaker screens in place. Because of the retainers proximity to the working surface of the shaker screen, the hold-down apertures must be covered to prevent solids in the drilling fluid from bypassing the shaker screen through the hold-down apertures. To prevent such bypass, an end cap assembly may be placed over each end of the filter screen to cover the hold-down apertures. Typically, such end caps are constructed by extending a metal cover over the hold-down apertures and attaching a wiper seal thereto so that the wiper seal contacts an adjacent wall of the shaker. Generally, wiper seals may be formed from any material capable of creating a seal between the shaker screen and the shaker. However typically, wiper seals are formed from rubbers, TPE, polychloroprene, polypropylene, and/or combinations thereof.

In one embodiment of the present disclosure, a thermoplastic end cap 119, formed by, for example, the injection molding process as described above, or any other method known to one of ordinary skill in the art, may be attached to a surface structure on the shaker screen 120. One such attachment point may include a metal plate located along the frame of the shaker. In alternate embodiments, end cap 119 may be directly coupled to the composite frame (not shown). In such embodiments, a wiper seal 121 may be attached to end cap 119 so as to form a seal between the shaker screen 120 and the shaker. Because the end cap 119 may be formed from a composite, wiper seal 121 may be attached using, for example, thermal bonding, ultrasonic welding, or heat staking, as described above. An attachment zone 122 provides an area of attachment for wiper seal 121 to either shaker screen 120 or to the composite frame. Because end cap 119 may be formed from a composite material, wiper seal 121 may be attached using, for example, thermal bonding, ultrasonic welding, or heat staking, as described above. In alternate embodiments, wiper seal 121 may be directly attached to the composite frame using any of the aforementioned methods of attachment.

In certain embodiments of the present disclosure, the frame and the sealing element may be formed at substantially the same time. In such an embodiment, the frame and the sealing element may be formed via co-extrusion. Generally, co-extrusion includes the process of extruding two or more materials through a single die with two or more orifices arranged so that the extrudates merge and weld together into a laminar structure before cooling. However, in other embodiments, co-extrusion may include the injection of more than two materials extruded into two or more dies. Those of ordinary skill in the art will appreciate that co-extrusion may be used to form both a frame and a sealing element in accordance with the embodiments disclosed herein.

In one aspect of the present disclosure, a first material is extruded into a first orifice (molded into a desired geometry for a frame) of a die while a second material is extruded into a second orifice (molded into a desired geometry of a sealing element) of the die. Both materials are allowed to cure, and then removed from the die. Because the materials were co-extruded, their interfacing profiles will substantially correspond. Thus, when the frame and the sealing element are aligned, their profiles will correspond such that they may be attached or coupled. By having a sealing element with a profile that substantially matches a corresponding frame, the attachment of the two components may be more secure.

Figure 9:
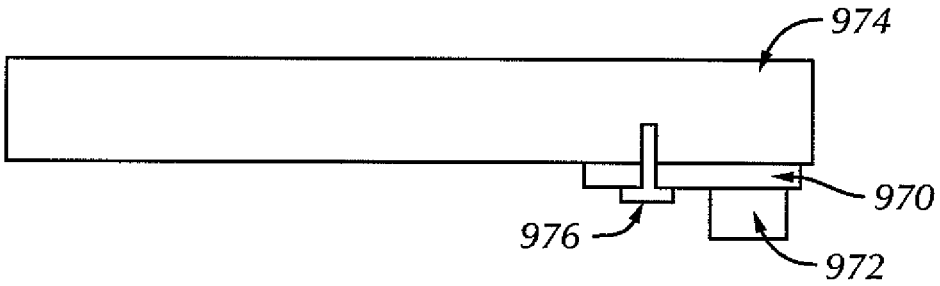
FIG. 9 is a side view of a sealing element attached to a screen frame in accordance with embodiments of the present disclosure.

In certain embodiments, the aligning of the co-extruded frame and seal may benefit from additional attachment means. Exemplary methods of additional attachment means may include mechanical fasteners (e.g., screws, bolts, and rivets), welding, heat staking, thermal bonding, and/or chemical adhesion. One such example is shown in FIG. 9, wherein a sealing element comprising a first portion 970 and a second portion 972 are mechanically attached to a screen frame 974 with a screw 976. First and second portions 970, 972 of the sealing element may be formed from a single material or, alternatively, from different materials. For example, the first portion 970 may be formed from polypropylene, while the second portion 972 may be formed from TPE.

To help ensure proper alignment between the frame and the sealing element, the frame may be formed to include a first mating surface, while the sealing element is formed to include a second mating surface configured to correspond to the first mating surface of the screen. In one embodiment, the second mating surface of the sealing element may include a groove configured to align with an extension of the first mating surface of the screen. In alternate embodiments, the first mating surface may include a groove, while an extension of the second mating surface is configured to align with the groove.

Moreover, those of ordinary skill in the art will appreciate that in certain embodiments having a first and second mating surface, the extension portion may be designed with a slightly larger profile than the corresponding groove. As such, when the extension is aligned within the groove, a compression fit may be achieved. Such a compression fit may enhance the sealing characteristics of the seal, while preventing the sealing element from becoming disconnected from the screen during operation of the shaker.

Those of ordinary skill in the art will appreciate that multiple configurations of first and second mating surface may be used when forming frames and sealing elements in accordance with embodiments disclosed herein. For example, combinations of male/female connections, press-fit connections, and dovetails may also be used. Furthermore, those of ordinary skill in the art will appreciate that any of the above methods of forming corresponding frames and sealing elements may be used without co-extrusion.

In other embodiments, as described above, a sealing element of a screen may be configured to interact with a surface of a shaker. In such an embodiment, a screen may be designed to include a first mating surface that is configured to align with a second mating surface on the shaker. For example, the first mating surface of the screen may be configured to interface with the second mating surface of a feed end of a shaker basket. Such a configuration may prevent drilling fluid and solid particles from bypassing the shaker, thereby increasing the efficiency of the operation. In other embodiments, at least a portion of a sealing element of a screen may be configured to align with or interface with at least a portion of a shaker to prevent the loss of drilling fluid and solid particles therefrom.

Advantageously, embodiments of the aforementioned apparatuses and methods may increase the efficiency of shaker systems for the separation of drilling fluid from drill cuttings. Because the sealing elements of the present disclosure may be directly attached to composite frames using thermal bonding and/or co-molding, a higher integrity seal may be formed therebetween. The seal may allow the sealing element to compress to an optimum level thereby preventing over-compression and subsequent failure of the sealing element. Additionally, the seal may be optimized by a co-molded rigid section formed within the composite frame. Such a rigid section may provide a hard stop to further enhance the operability of the sealing element so as to form a higher integrity seal while also extending seal life. Because seal life may be extended, shaker screens may not need to be changed as frequently, thus limiting the downtime of the shaker.

Furthermore, shaker screens in accordance with the present disclosure may decrease the cost and time of repairing seals. Because the sealing elements may be formed around a basal perimeter of the shaker screens, and not around an inner perimeter of the shaker, when seal damage occurs, only the screen must be replaced. One of ordinary skill in the art will appreciate that replacing a screen with an attached sealing element is less labor intensive and requires less time than replacing a sealing element located on the inner perimeter of a shaker. Thus, sealing elements that are thermally bonded and/or co-molded to a composite frame, as disclosed herein, may decrease the cost of routine maintenance thereby increasing the cost efficiency of the shaking process.

Also, thermal bonding and co-molding techniques described herein may provide advantageous sealing element design variations. Because the sealing elements may be attached to the composite frame using such thermal bonding and co-molding there may be less of a need to use epoxies and chemical bonding techniques. Such epoxy and chemical bonding techniques created attachments that degraded over time due to contact with abrasive drilling fluids. As such, chemically bonded seals may have a shorter effective life relative to embodiments of the present disclosure. Additionally, because thermal bonding and co-molding techniques do not use environmentally hazardous chemicals, processes of the present disclosure are more environmentally sensitive.

Moreover, design variations of the sealing elements in accordance with embodiments disclosed herein may provide greater integrity seals. Sealing elements of the present disclosure may include an outer surface and an inner area that enhances sealing integrity between the shaker screen and the shaker. Specifically, because a lower durometer material may form an outer surface while higher durometer material may form an inner area, the compression of the seal may be optimized for a specified operation. Also, embodiments disclosed herein provide the advantage of allowing an inner core to be filled with compressive material (e.g., foam) or other materials (e.g., gases) such that the formation of the sealing element alone may provide optimization of seal compression. Other design variations may provide optimized sealing compression through, for example a plurality of ribs, thereby increasing seal integrity.

Those of ordinary skill in the art will appreciate that certain embodiments disclosed herein may also advantageously provide for a permanently attached sealing element that does not require the use of adhesives. Because components of the shaker screen may be co-extruded and fastened together using, for example, mechanical fasteners, the sealing elements may also be selectively removable should the sealing element fail during use and require replacement. Certain embodiments may also allow the replacement of the sealing elements to be relatively fast do to the co-extruded components.

Finally, embodiments in accordance with the present disclosure may advantageously allow the attachment of alternative sealing elements (e.g., wiper seals) to the shaker screen frame or extensions thereof. Of particular advantage in certain embodiments, a wiper seal may be attached directly to a composite frame or directly to an end cap such that more drilling fluids are retained over the screen surface rather than escaping through attachment apertures of the shaker screen.

While the invention has been described with respect to a limited number of embodiments, those skilled in the art, having benefit of the present disclosure, will appreciate that other embodiments may be devised with do not depart from the scope of the disclosure described herein. Accordingly, the scope of the disclosure should be limited only by the claims amended hereto.

What is claimed is:

1. A shaker screen comprising:

a sealing element; and a composite frame comprising a rigid molded section defining an extended portion of the composite frame;

wherein the sealing element is attached to a basal perimeter of the composite frame.

2. The shaker screen of claim 1, wherein an outer surface of the sealing element has a substantially rounded face.

3. The shaker screen of claim 1, wherein an inner area of the sealing element is substantially hollow.

4. The shaker screen of claim 1, wherein an inner area of the sealing element is gas-filled.

5. The shaker screen of claim 1, wherein an inner area of the sealing element is foam-filled.

6. The shaker screen of claim 1, wherein the sealing element further comprises a series of support ribs.

7. The shaker screen of claim 1, wherein the sealing element further comprises a thermoplastic elastomer outer shell.

8. The shaker screen of claim 1, wherein an outer surface of the sealing element comprises a lower durometer material than an inner area of the sealing element.

9. The shaker screen of claim 1, further comprising a filtering element attached to the composite frame.

10. The shaker screen of claim 1, wherein the molded rigid section is integral to the composite frame.

11. A method of forming a shaker screen comprising:

forming a sealing element;

forming a composite frame having a rigid molded section defining an extended portion of the composite frame; and attaching the sealing element to the composite frame;

wherein the sealing element is disposed along at least one surface of a basal perimeter of the composite frame.

12. The method of forming a shaker screen of claim 11, wherein the attaching the sealing element to the composite frame comprises co-molding the sealing element and the composite frame.

13. The method of forming a shaker screen of claim 12, wherein the sealing element is co-molded to a rigid molded section extending along the basal perimeter of the composite frame.

14. The method of forming a shaker screen of claim 11, wherein the attaching the sealing element to the composite frame comprises bonding the sealing element to the composite frame.

15. The method of forming a shaker screen of claim 14, wherein the bonding comprises thermal bonding.

16. The method of forming a shaker screen of claim 11, further comprising:

bonding a wiper seal to a thermoplastic cap disposed on the composite frame.

17. The method of forming a shaker screen of claim 11, further comprising:

attaching a filtering element to the composite frame.

18. The method of claim 11, wherein the forming comprises co-extruding the frame and the sealing element.

19. The method of claim 18, wherein the attaching further comprises securing the sealing element to the frame by at least one of a group consisting of mechanical fastening, welding, heat staking, thermal bonding, and chemical adhesion.

20. The method of claim 19, wherein the attaching further comprises sliding the sealing element into the groove on the frame.

21. The method of claim 18, wherein the first mating surface of the frame comprises a groove, and the second mating surface of the sealing element comprises an extension configured to align with the groove.

22. The method of claim 11, wherein the attaching comprises aligning a first mating surface of the frame to a second mating surface of the sealing element.

23. A shaker screen attachment comprising:

a sealing element;

a composite frame having a rigid molded section defining an extended portion of the composite frame; and a wedge;

wherein the sealing element is attached to a basal perimeter of the composite frame, and wherein the wedge is disposed between the composite frame and a shaker basket such that the sealing element compresses against the shaker basket.

24. The shaker screen attachment of claim 23, wherein the rigid molded section defines an extended portion of the composite frame and further defines a compression limit of the sealing element.

* * * * *